United States Patent [19]

Schuder

[11] Patent Number: 4,480,292

[45] Date of Patent: Oct. 30, 1984

[54] LIGHT ASSEMBLY

[75] Inventor: Maurice E. Schuder, Indianapolis, Ind.

[73] Assignee: Emhart Industries, Inc., Indianapolis, Ind.

[21] Appl. No.: 364,008

[22] Filed: Mar. 31, 1982

[51] Int. Cl.[3] ..... F21V 33/00

[52] U.S. Cl. ..... 362/95; 362/226; 362/234; 362/251; 362/295; 362/394; 200/315

[58] Field of Search ..... 362/36, 95, 226, 234, 362/242, 251, 295, 394, 401; 200/56 R, 61.7, 153 A, DIG. 47, 315

[56] References Cited

U.S. PATENT DOCUMENTS

| | | | |
|---|---|---|---|
| 2,498,943 | 2/1950 | Courtney | 362/251 |
| 3,598,950 | 8/1971 | Ohashi | 200/315 |
| 3,735,077 | 5/1973 | Ohashi | 200/315 |
| 4,340,791 | 7/1982 | Sorenson | 200/315 |

*Primary Examiner*—Donald P. Walsh
*Attorney, Agent, or Firm*—Robert F. Meyer

[57] ABSTRACT

A pair of lights are carried in a housing. One of the lights is in a constant "on" position, while the other is intermittently turned "on" and "off" through a switch means. The switch means is open and closed through a contact arm that is carried on a pivotally mounted cover for the housing.

4 Claims, 5 Drawing Figures

LIGHT ASSEMBLY

BACKGROUND OF THE INVENTION

Generally speaking, the present invention relates to a light assembly which comprises a housing having a base and an open end, a cover pivotally carried in the open end, a pair of electrical terminals carried within the housing and extending outside thereof, a first retaining means electrically connected to the pair of electrical terminals and carried within the housing on the base and adapted to receive a first light means, a third electrical terminal carried within the housing and extending outside thereof, second retaining means electrically connected to the third electrical terminal and adapted to receive a second light means, switch means electrically connecting the first and second retaining means, an electrical contact means carried by the cover selectively engaging the switch means to open and close same, and at least one window in the housing exposing the first and second light means.

The present invention pertains to a switch assembly which is particularly adaptable in automobiles for reading material such as maps. The switch is adapted to be plugged into the dashboard of an automobile and includes a pair of lights one of which may be left on constantly and another one may be turned on when an item such as a map needs to be read at night.

FEATURES OR OBJECTS OF THE INVENTION

It is, therefore, a feature of the present invention to provide a light assembly that is particularly adaptable for reading items at night in an automobile. Another feature of the invention is to provide an assembly which includes a pair of lights one of which can be left on constantly and the other one selectively turned on and off. Another feature of the invention is to provide such an assembly wherein one light is electrically connected to a pair of electrical terminals and the other light is connected to a single electrical terminal and to the other light through a switch. Still another feature of the invention is to provide such an assembly wherein the switch includes a fixed electrical contact blade connected to the intermittent light and a movable contact blade connected to the constant light. Another feature of the invention is to provide such an assembly wherein the switch is actuated through an electrical contact carried by a pivotally mounted cover of the housing. Yet another feature of the invention is to provide such an assembly having windows in the cover and wherein there is a means to divide the cover into compartments to separate the lights. These and other features of the invention will become apparent from the following description taken in conjunction with the accompanying drawings.

DETAILED DESCRIPTION OF THE INVENTION

Figure 1:
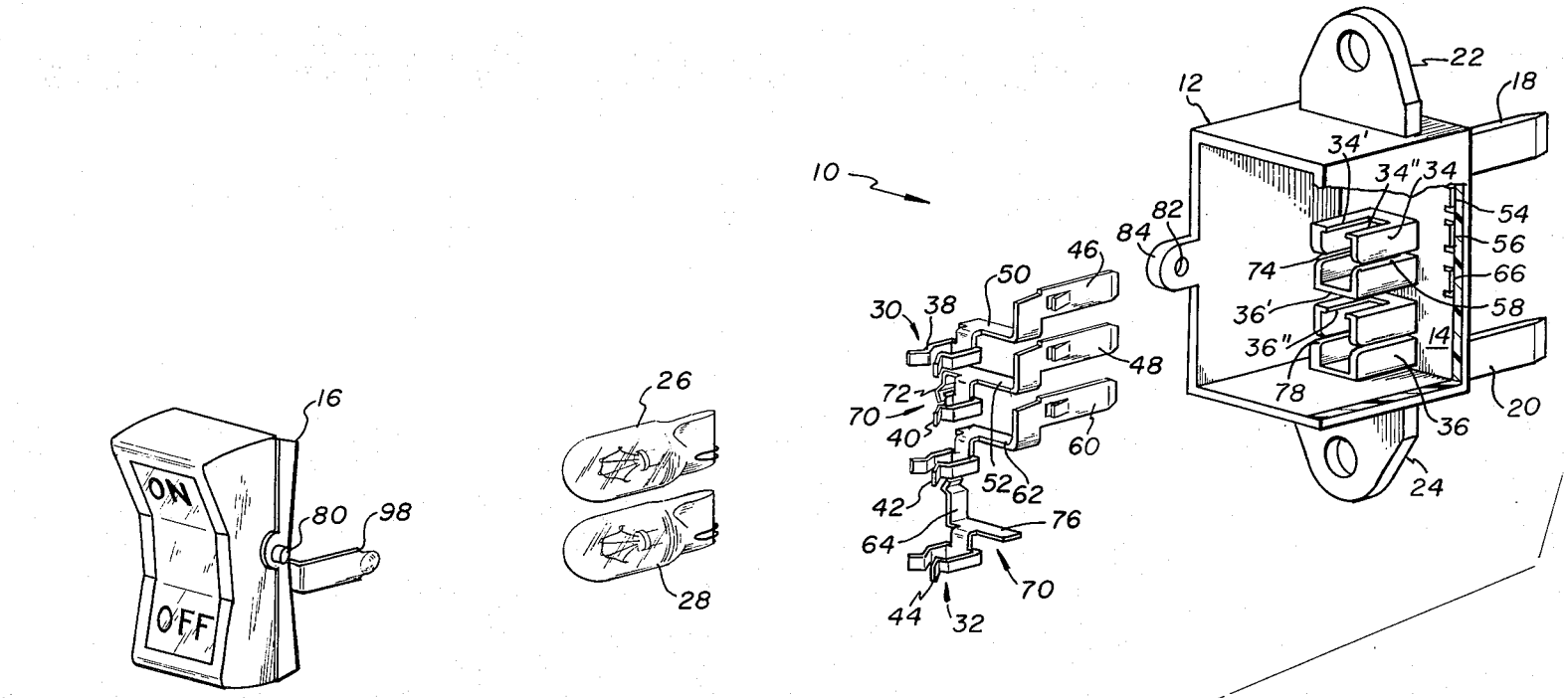
FIG. 1 is an exploded view of a light assembly employing the features of the invention.

Referring now to the drawings, there is shown a light assembly 10 which is encased in a housing 12 having a base 14 and a cover 16. A pair of legs 18 and 20 can be engaged with a base member such as a dashboard of an automobile or a plug receptacle, for example. In addition, a pair of ears 22 and 24 can be used to further attach the switch to the dashboard.

A pair of light bulbs 26 and 28 are carried in a retaining means 30 and 32, the retaining means being carried in compartments 34 and 36 which are carried on the base 14 of the housing. As shown, retaining means 30 and 32 include clips 38, 40, 42 and 44. Clips 38 and 40 are electrically connected to electrical terminals 46 and 48 through bus bars 50 and 52. Electrical terminal 46 extends through the housing through slot 54 with the bus bar 50 being carried along the side 34' of compartment 34 and extending into slot 34" of the compartment. Terminals 48 extends through opening 56 with bus bar 52 extending through slot 58 of compartment 34. Clip 42 is electrically connected to terminal 60 through bus bar 62 and is also electrically connected to clip 44 through bus bar 64. Terminal 60 extends through slot 66 of the base 14 with bus bar 62 lying along the side 36' of compartment 36 with the clip extending through opening 36" of the compartment.

A switch means 70 electrically connects lamps 26 and 28 together. Switch means 70 includes a movable blade 64 which extends through and outside compartment 36 through a slot 78 of the compartment and a fixed contact blade 72 which extends out of compartment 34 through slot 74.

Figure 2:
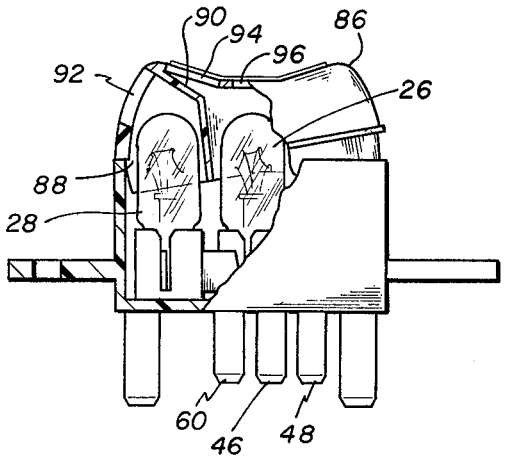
FIG. 2 is a side view of the assembly with portions thereof being removed.
Figure 3:
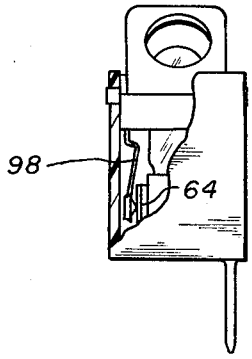
FIG. 3 is an end view of the assembly with portions being removed.

Cover 16 is pivotally mounted on the housing through a pair (one shown) of axles 80 which engage a pair of apertures (one shown) 82 provided in a pair of ears 84. As is more clearly shown in FIG. 2, the cover is cup-shaped with a base 86 and an open end 88 and is compartmentalized through a divider 90 to form window viewing compartments for the lights 26 and 28. The cover includes a window 92 for light 28 and a pair of windows 94 and 96 for light 26. The cover carries an electrical contact arm 98 (FIG. 1) which as hereinafter will be explained selectively engages switch means 70 to open and close it.

Figure 4:
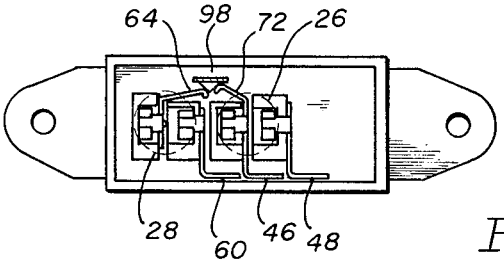
FIGS. 4 and 5 are top views with portions being removed showing different operating modes of the light assembly.
Figure 5:
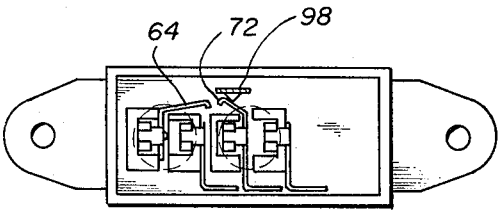

In operation, light 26 remains on through the plug-in of electrical terminals 46 and 48 to a separate circuit which can be energized as desired. Upon actuation of the cover 16 to the "on" position, contact bar 98 will, as shown in FIG. 4, complete a circuit through the movable blade 64 and fixed blade 72 to provide an electrical circuit from light 26 through light 28 to electrical terminal 60. FIG. 5 shows the cover actuated to the "off" position to move contact bar 98 and open the switch.

Referring to FIG. 4, for a clearer view, in those applications where the constant light 26 is not needed, terminal 48 could be eliminated and retaining means 30 could serve as an electrical busing means connecting terminal 48 with movable blade 72.

I claim:

1. A light assembly comprising (a) a housing having a base and an open end, (b) a cover pivotally carried in said open end, (c) a pair of electrical terminals carried within said housing and extending outside thereof, (d) a first retaining means electrically connected to said pair of electrical terminals and carried within said housing on said base and adapted to receive a first light means, (e) a third electrical terminal carried within said housing and extending outside thereof, (f) second retaining means electrically connected to said third electrical terminal and adapted to receive a second light means, (g) a fixed electrical contact blade carried by said second retaining means and a movable electrical contact blade carried by said first retaining means, (h) an electrical contact bar carried by said cover continually engaging said fixed electrical contact blade and selectively engaging said movable electrical contact blade upon actuation of said cover, and (i) at least one window in said housing.

2. A light assembly according to claim 1 wherein said first and second retaining means includes at least one clip adapted to receive said light means.

3. A light assembly according to claim 1 wherein said cover is cup-shaped having an open end open to said cup-shaped member and includes means dividing same into a compartment for said first and second light means.

4. A light assembly according to claim 1 wherein said window is provided in said cover.

* * * * *